US010799004B2

(12) United States Patent
Chan et al.

(10) Patent No.: US 10,799,004 B2
(45) Date of Patent: Oct. 13, 2020

(54) PORTABLE ELECTRONIC DEVICE CASE

(71) Applicant: Pioneer Square Brands, Inc., Seattle, WA (US)

(72) Inventors: Jaimie Emerald Chan, Renton, WA (US); Michael Cooper Ferren, Seattle, WA (US)

(73) Assignee: PIONEER SQUARE BRANDS, INC., McLean, VA (US)

( * ) Notice: Subject to any disclaimer, the term of this patent is extended or adjusted under 35 U.S.C. 154(b) by 293 days.

(21) Appl. No.: 15/876,588

(22) Filed: Jan. 22, 2018

(65) Prior Publication Data

US 2019/0223571 A1 Jul. 25, 2019

(51) Int. Cl.

| | |
|---|---|
| ***A45C 11/08*** | (2006.01) |
| ***A45C 3/00*** | (2006.01) |
| ***A45C 13/02*** | (2006.01) |
| ***A45C 7/00*** | (2006.01) |
| ***A45C 11/00*** | (2006.01) |
| ***A45C 13/10*** | (2006.01) |

(52) U.S. Cl.

CPC ..... *A45C 11/08* (2013.01); *A45C 3/001* (2013.01); *A45C 7/0077* (2013.01); *A45C 11/00* (2013.01); *A45C 13/02* (2013.01); *A45C 13/1069* (2013.01); *A45C 2011/001* (2013.01); *A45C 2011/002* (2013.01); *A45C 2011/003* (2013.01)

(58) Field of Classification Search

CPC ..... A45C 11/00; A45C 11/08; A45C 7/0077; A45C 13/1069; A45C 13/02; A45C 2011/001–003

USPC ..... 229/128, 4.5, 104, 121, 71, 103; 383/42, 383/57, 98; 215/12.1; D9/414, 430, 415, D9/433

See application file for complete search history.

(56) References Cited

U.S. PATENT DOCUMENTS 2,802,565 A * 8/1957 Kabbash ..... B65D 5/38 229/125.015
2,964,227 A * 12/1960 Goldsholl ..... B65D 5/0209 229/128
3,010,571 A * 11/1961 Transport ..... B65D 5/0209 206/758
3,125,258 A * 3/1964 Watts ..... B65D 5/723 222/480
3,343,743 A * 9/1967 Hamilton, Jr. ..... B65D 5/0209 229/117.24
3,366,312 A * 1/1968 Lowenberg ..... B65D 33/24 383/33
3,637,130 A * 1/1972 Farquhar ..... B65D 5/0209 229/243
3,924,799 A * 12/1975 Lorenz ..... B65D 5/02 206/418
3,929,222 A * 12/1975 Smith ..... B65D 5/0209 206/783
D248,375 S * 7/1978 Bergstein ..... A61B 17/06133 D9/415

(Continued)

*Primary Examiner* — Chun Hoi Cheung
*Assistant Examiner* — Brijesh V. Patel
(74) *Attorney, Agent, or Firm* — Grandview Law

(57) ABSTRACT

Systems and methods are involved with but are not limited to a first side and a second side and a first wall extending between the first side and the second side, the first wall including a first semirigid board with a first bowed configuration and a first flat configuration. In addition to the foregoing, other aspects are described in the claims, drawings, and text forming a part of the present disclosure.

11 Claims, 12 Drawing Sheets

(56) References Cited

U.S. PATENT DOCUMENTS

| | | | | | |
|---|---|---|---|---|---|
| 4,946,289 | A * | 8/1990 | Bolling | B65D 33/24 | 383/204 |
| 5,048,749 | A * | 9/1991 | Wischusen | B65D 75/008 | 229/125.02 |
| 5,071,061 | A * | 12/1991 | Willis | B65D 27/06 | 229/303 |
| 5,911,358 | A * | 6/1999 | Kenner | A01K 97/06 | 206/315.11 |
| 6,098,872 | A * | 8/2000 | Ong | A61B 17/06133 | 206/380 |
| D438,105 | S * | 2/2001 | Conner | B65D 75/008 | D7/509 |
| 6,595,687 | B2 * | 7/2003 | Godshaw | A01K 97/06 | 206/315.11 |
| 6,719,128 | B2 * | 4/2004 | Alpern | A61B 17/06133 | 206/380 |
| D495,209 | S * | 8/2004 | Tranfaglia | A45C 7/0095 | D7/509 |
| 7,451,909 | B2 * | 11/2008 | Sexton | B42D 15/045 | 229/128 |
| 8,905,987 | B2 * | 12/2014 | Murray | A61F 5/4407 | 604/332 |
| 9,642,428 | B2 * | 5/2017 | Brown | G06F 1/1656 | |
| 2007/0031071 | A1 * | 2/2007 | Perrette | A45C 3/001 | 383/42 |
| 2010/0089779 | A1 * | 4/2010 | Bowers | A45C 7/0095 | 206/320 |

* cited by examiner

PORTABLE ELECTRONIC DEVICE CASE

SUMMARY

In one aspect, an apparatus includes, but is not limited to, a first side and a second side; a first wall extending between the first side and the second side, the first wall including a first semirigid board with a first bowed configuration and a first flat configuration; and a second wall extending between the first side and the second side, the second wall including a second semirigid board with a second bowed configuration and a second flat disposition; wherein the portable electronic device case is capable of change of disposition between an expanded disposition and a collapsed disposition, the expanded disposition including the first semirigid board being in the first bowed configuration and the second semirigid board being in the second bowed configuration whereby the expanded disposition of the portable electronic device case includes an interior space sufficient to house a portable electronic device, the collapsed disposition with the first semirigid board being in the first flat configuration and the second semirigid board being in the second flat configuration.

In addition to the foregoing, various other aspects are set forth and described in the teachings such as text (e.g., claims and/or detailed description) and/or drawings of the present disclosure. The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of embodiments, reference now is made to the following descriptions taken in connection with the accompanying drawings. The use of the same symbols in different drawings typically indicates similar or identical items, unless context dictates otherwise.

With reference now to the figures, shown are one or more examples of disparate material outsole based articles of manufacture, compositions of matter, systems for producing and/or methods for producing same that may provide context, for instance, in introducing one or more processes and/or devices described herein.

DETAILED DESCRIPTION

Figure 1:
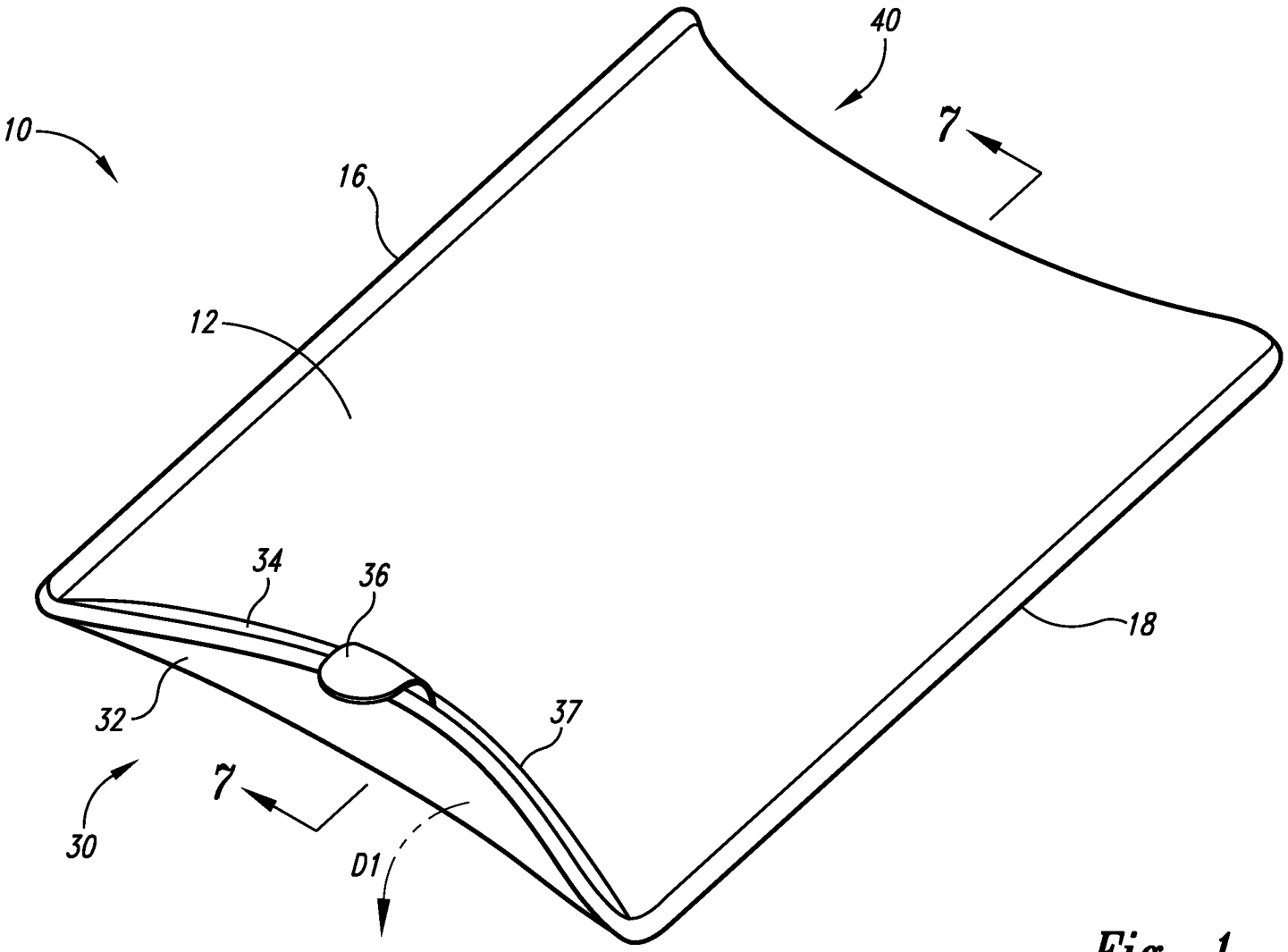
FIG. 1 is an exterior perspective view of portable device case in expanded disposition with first flap and second flap of first end closed.

In the following detailed description, reference is made to the accompanying drawings, which form a part hereof In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Conventional cases for portable electronic devices such as tablets and laptops have external dimensions that remain the same size whether the conventional cases contain anything or not, which may not be desirable when they are empty.

Turning to FIG. 1, a portable device case 10 is depicted in expanded disposition having first wall 12 in bowed configuration extending between first side 16 and second side 18. At its first end 30, portable device case 10 is shown with first flap 32 closed against second flap 34, which is also closed and shown with tab 36 (such as polyurethane or other poly material or other durable/soft material for one-handed access) coupled to second flap 34. As shown in FIG. 1, when first flap 32 is closed against second flap 34, a small portion of second flap 34 remains visible where second flap 34 extends from first wall 12 along first edge 37. When first wall 12 is in bowed configuration, first edge 37 is arched shaped as shown in FIG. 1. Also shown, first flap 32 is shaped to conform with the arch shape of first edge 37. Arrow D1 indicates direction of how first flap 32 would open.

Figure 2:
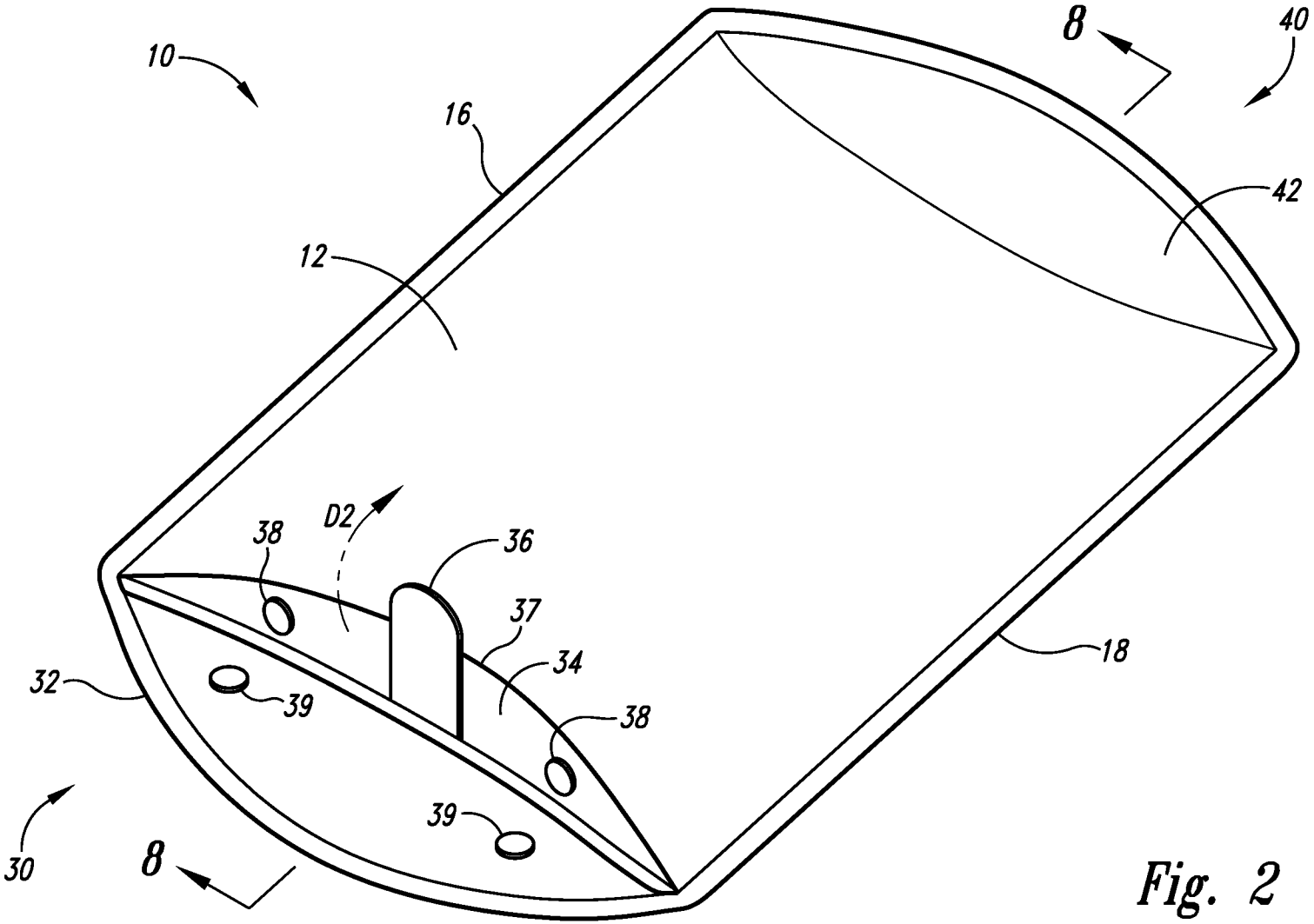
FIG. 2 is an exterior perspective view of the portable device case of FIG. 1 in expanded disposition with first flap of first end open and second flap of first end closed.

Turning now to FIG. 2, portable device case 10 is shown in expanded disposition with first flap 32 open showing first magnets 38 and second magnets 39 separated from each other. When first flap 32 is closed against second flap 34, first magnets 38 and second magnets 39 are held together by magnetic forces to provide resistance force to keep first flap 32 closed. When Tab 36 is first pulled, it can assist in opening first flap 32 and then when continued to be pulled it can further assist in opening second flap 34. The portable device case 10 is also shown with second end 40 having its first flap 42 open. Arrow D1 indicates direction of how second flap 34 would open.

Figure 3:
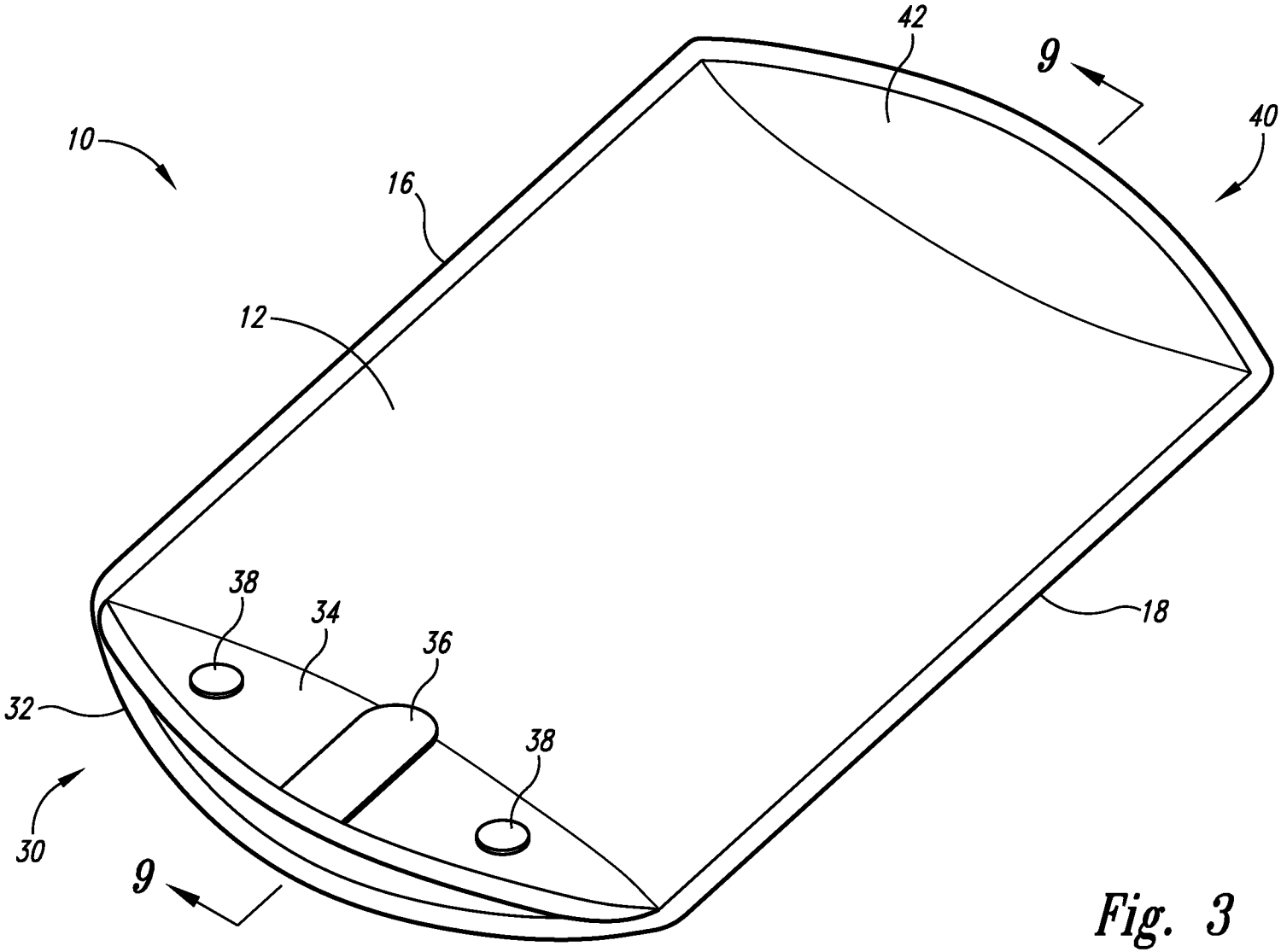
FIG. 3 is an exterior perspective view of the portable device case of FIG. 1 in expanded disposition with first flap and second flap of first end open.

Referring now to FIG. 3, portable device case 10 is shown in expanded disposition with first end 30 having its first flap 32 open and its second flap 34 open and with second end 40 having its first flap 42 open.

Figure 4:
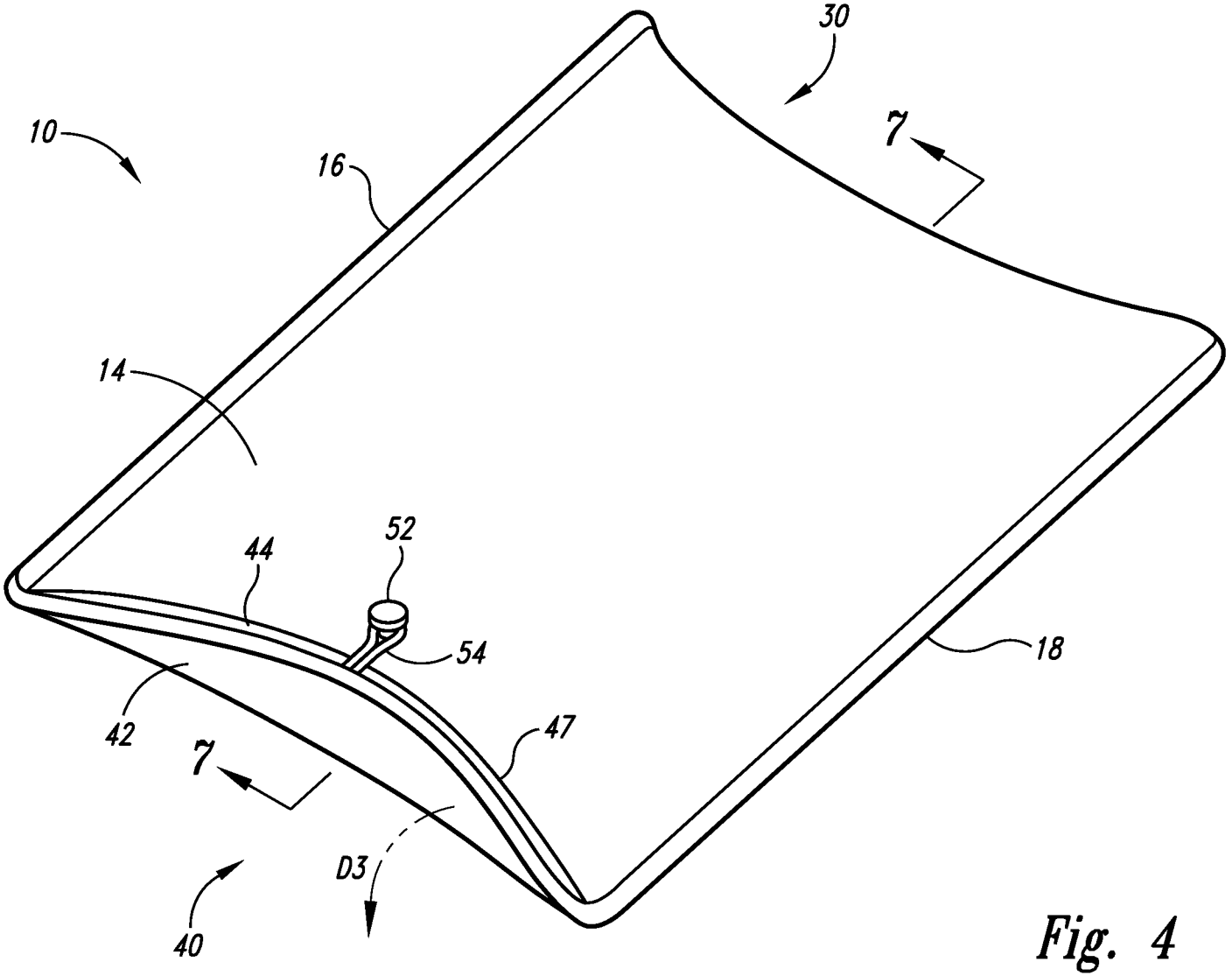
FIG. 4 is an exterior perspective view of the portable device case of FIG. 1 in expanded disposition with first flap and second flap of second end closed.

Turning now to FIG. 4, portable device case 10 is shown in expanded disposition having second wall 14 in bowed configuration extending between first side 16 and second side 18. At its second end 40, portable device case 10 is shown with first flap 42 closed against second flap 44. As shown in FIG. 4, when first flap 42 is closed against second flap 44, a small portion of second flap 44 remains visible where second flap 44 extends from second wall 14 along second edge 47. When second wall 14 is in bowed configuration, second edge 47 is arched shaped as shown in FIG. 4. Also shown, first flap 42 is shaped to conform with the arch shape of second edge 47. Arrow D3 indicates direction of how first flap 42 would open.

Figure 5:
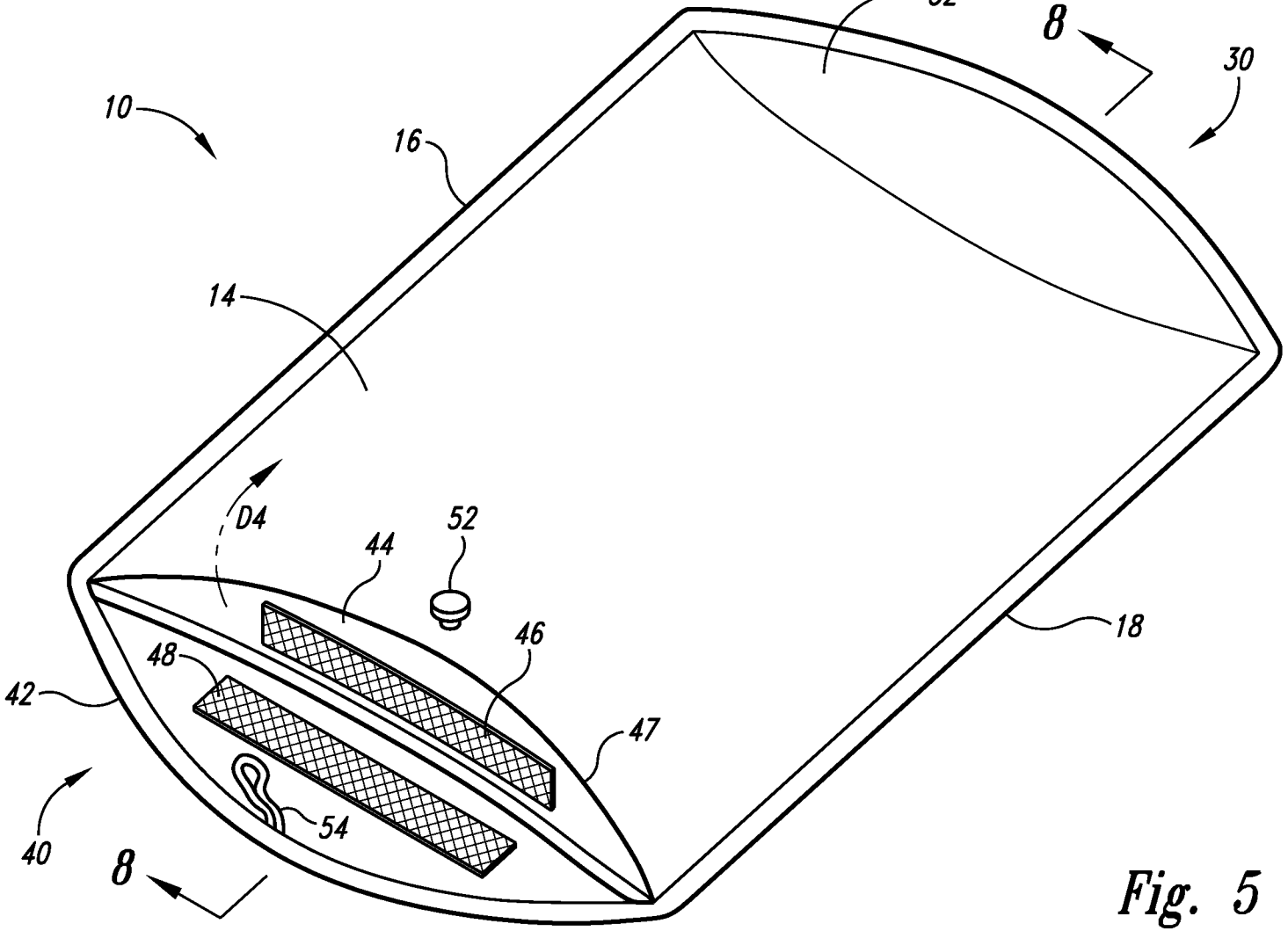
FIG. 5 is an exterior perspective view of the portable device case of FIG. 1 in expanded disposition with first flap of first end open and second flap of second end closed.

Referring now to FIG. 5, portable device case 10 is shown in expanded disposition with first flap 42 open and second flap 44 closed. Also shown is band 54 (such as elastic band or other stretchable material) unhooked from post 52 and first hook-loop-fastener-strip-pair component (such as Velcro) 46 uncoupled from complementary second hook-loop-fastener-strip-pair component (such as Velcro) strip 48. When coupled together, first hook-loop-fastener-strip-pair component 46 and its complementary second hook-loop-fastener-strip-pair component 48 assist in keeping second flap 44 shut against first flap 42. When coupled together, post 52 and band 54 assist in keeping second flap 44 shut against first flap 42. Arrow D4 indicates direction of how second flap 44 would open.

Figure 6:
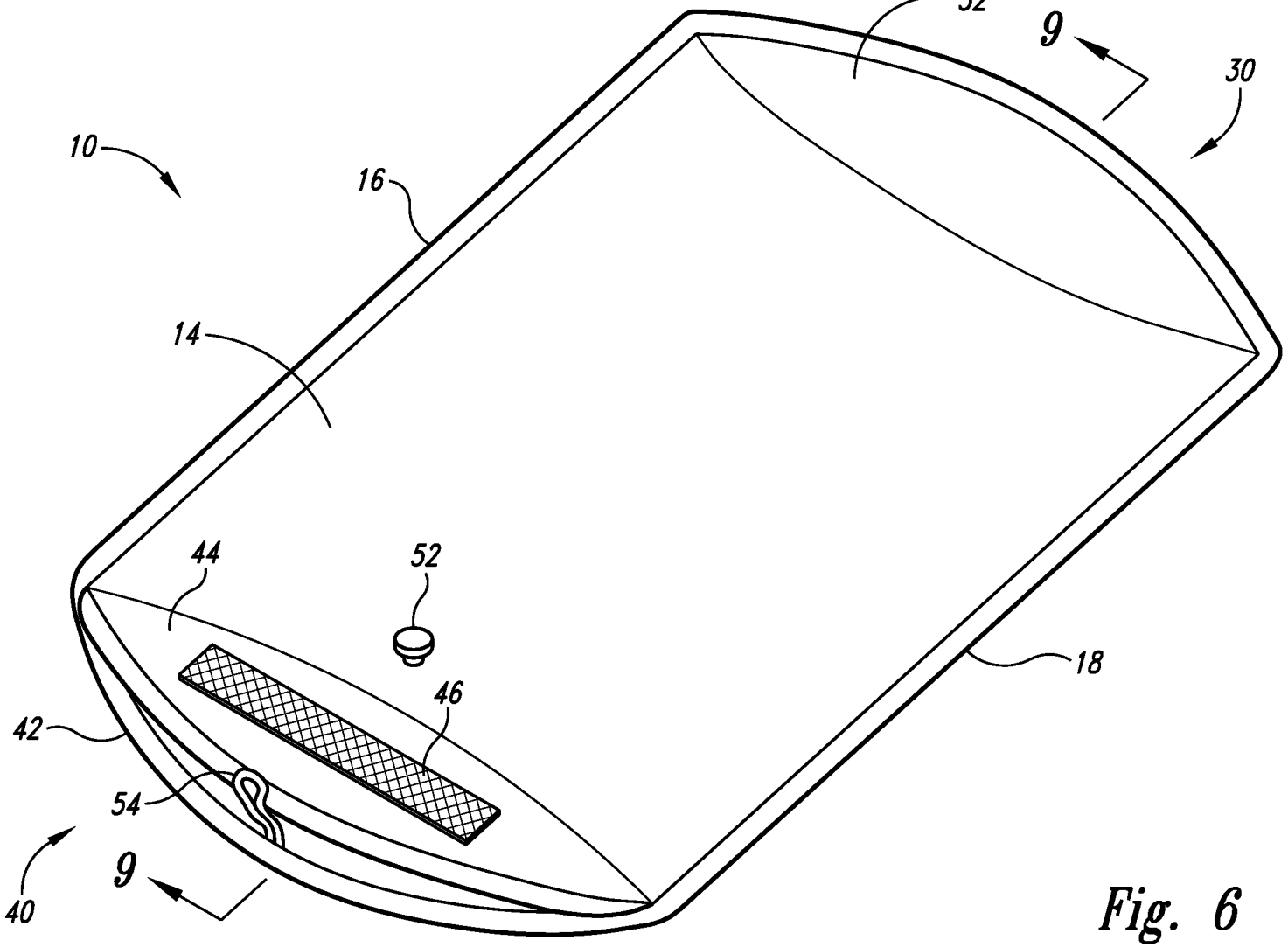
FIG. 6 is an exterior perspective view of the portable device case of FIG. 1 in expanded disposition with first flap and second flap of second end open.

Referring now to FIG. 6, portable device case 10 is shown in expanded disposition with second end 40 having its first flap 42 open and its second flap 44 open and with first end 30 having its first flap 32 open.

Figure 7:
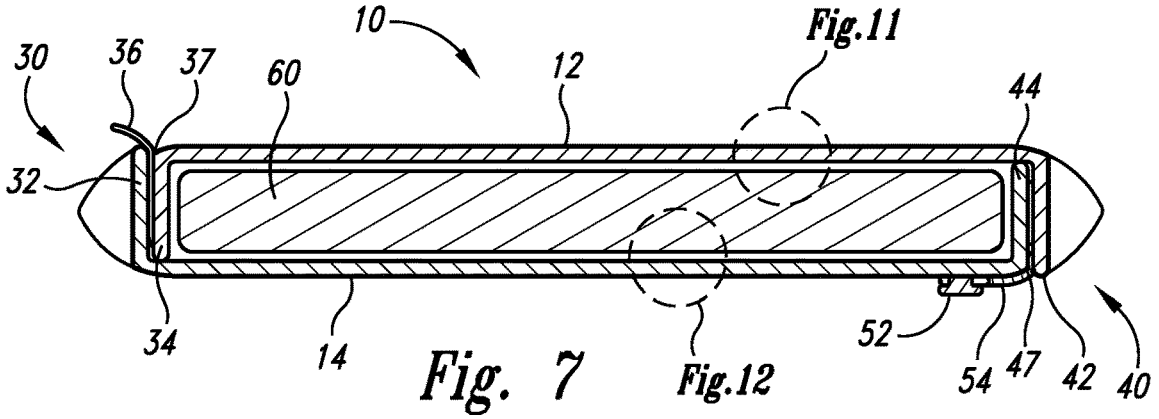
FIG. 7 is a cross-sectional side-elevational view of the portable device case along 7-7 cut line of FIG. 1 and FIG. 4 showing portable device case in expanded disposition with first flap of first end closed, second flap of first end closed, first flap of second end closed, and second flap of second end closed.

Turning now to FIG. 7, portable device case 10 is shown in cross-sectional side-elevational view along 7-7 cut line of FIG. 1 and FIG. 4 in expanded disposition as containing portable device 60 in an interior space of the portable device case 10 with first flap 32 closed and second flap 34 closed so that first end is securely closed, and first flap 42 closed and second flap 44 closed so that second is doubly closed.

Figure 8:
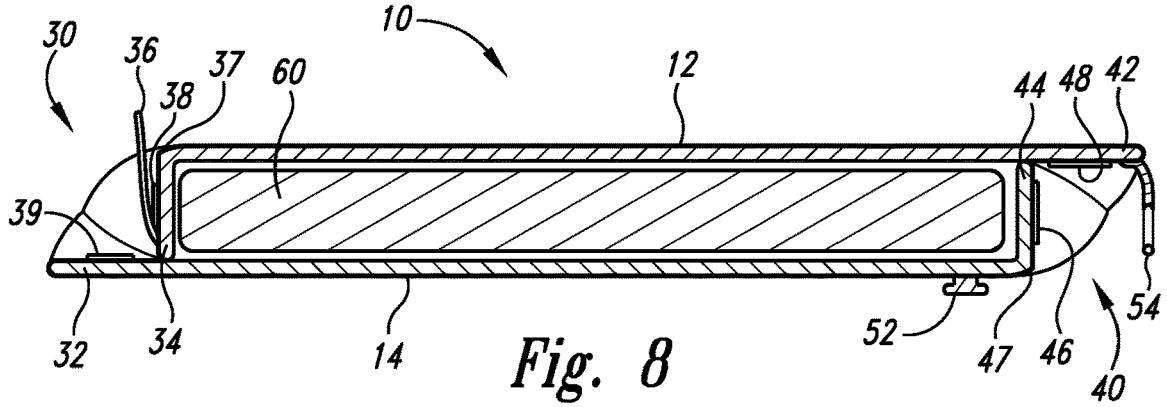
FIG. 8 is a cross-sectional side-elevational view of the portable device case along 8-8 cut line of FIG. 2 and FIG. 5 showing portable device case in expanded disposition with first flap of first end open, second flap of first end closed, first flap of second end open, and second flap of second end closed.

Referring now to FIG. 8, portable device case 10 is shown in cross-sectional side-elevational view along 8-8 cut line of FIG. 2 and FIG. 5 in expanded disposition as containing portable device 60 with first flap 32 open and second flap 34 closed so that first end is closed but not secured, and first flap 42 open and second flap 44 closed so that second end is singly closed.

Figure 9:
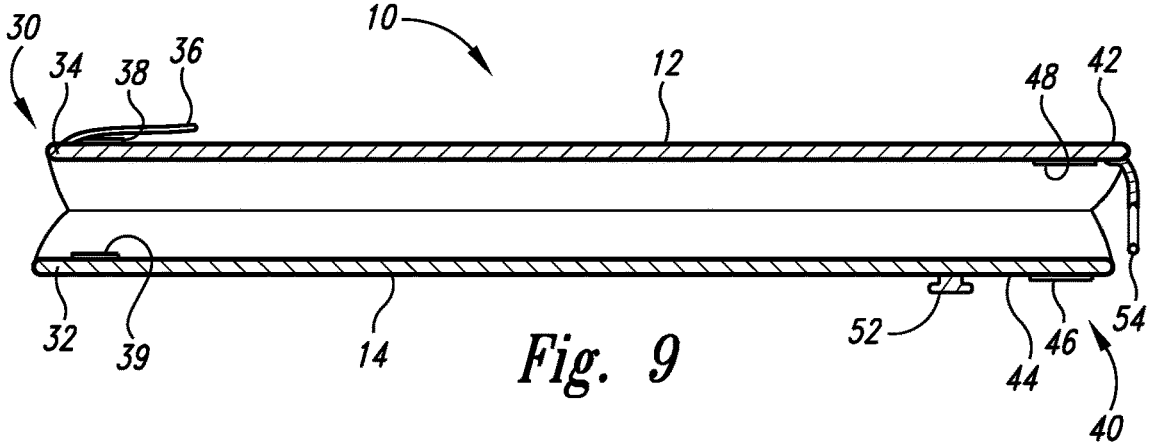
FIG. 9 is a cross-sectional side-elevational view of the portable device case along 9-9 cut line of FIG. 3 and FIG. 6 showing portable device case in expanded disposition with first flap of first end open, second flap of first end open, first flap of second end open, and second flap of second end open.

Turning now to FIG. 9, portable device case 10 is shown in cross-sectional side-elevational view along 9-9 cut line of FIG. 3 and FIG. 6 showing portable device case 10 in expanded disposition with first flap 32 open and second flap 34 open so that first end 30 is open, and first flap 42 open and second flap 44 open so that second end 40 is open.

Figure 10:
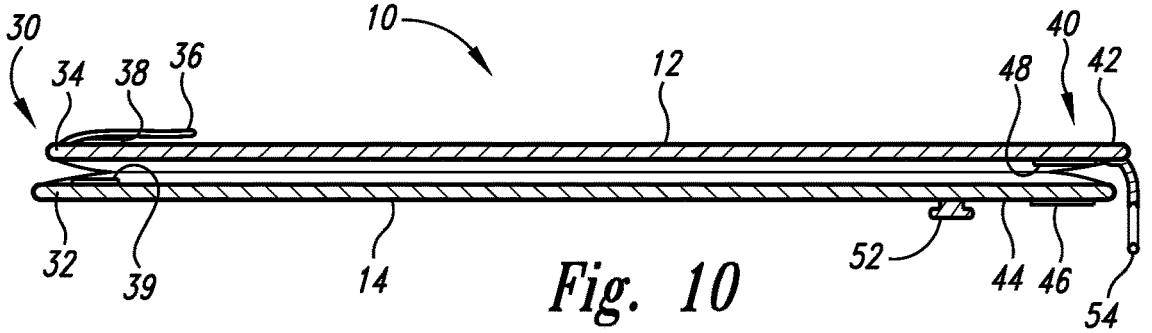
FIG. 10 is a cross-sectional side-elevational view of the portable device case in collapsed disposition with first flap of first end open, second flap of first end open, first flap of second end open, and second flap of second end open.

Referring now to FIG. 10, portable device case 10 is shown in cross-sectional side-elevational view showing portable device case 10 in collapsed disposition with first flap 32 open, second flap 34 open, first flap 42 open, and second flap 44 open.

Figure 11:
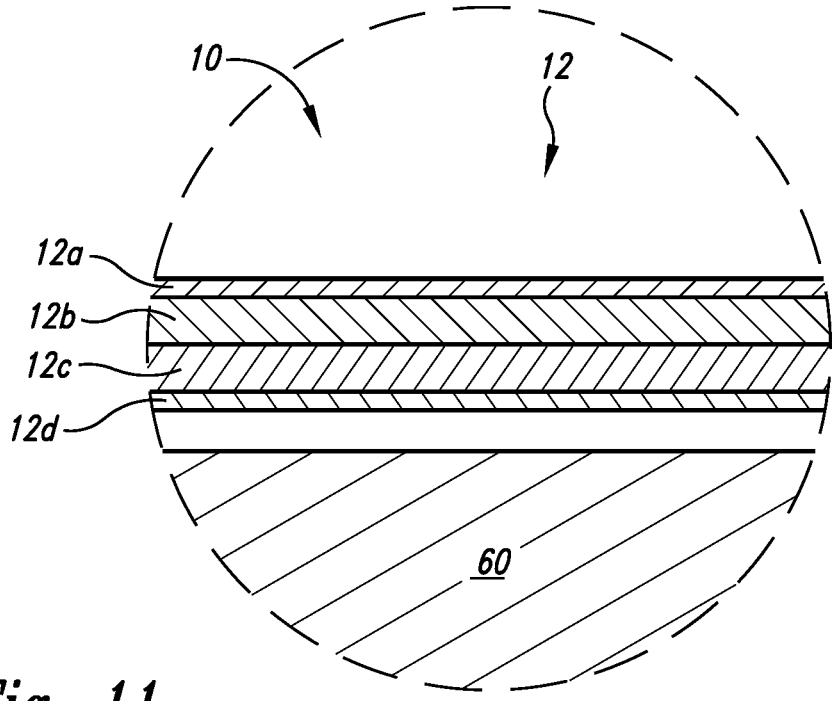
FIG. 11 is an enlarged cross-sectional side-elevational view showing a portion of first wall of the portable device case.

Turning now to FIG. 11 a portion of first wall 12 of portable device case 10 is shown in enlarged cross-sectional side-elevational view having exterior layer 12*a* (such as cortex material, dotted polyurethane or other poly material, other synthetic material, or other fabric material), inner layer 12*b* (such as semirigid board material such as a semirigid plastic sheet material or other semirigid sheet material that has flexibility sufficient to be in bowed configuration regarding expanded disposition and to be in flat configuration regarding collapsed disposition while having sufficient stiffness to maintain each configuration along with the other layers until sufficient force is applied to change configurations), inner layer 12*c* (such as foam material to protect device—foam material being placed internally to protect all six sides of device), and interior layer 12*d* (such as polyurethane or other poly material, other synthetic material, or other fabric material). In implementations, the inner layer 12*b*, as a semirigid board material, can serve as a first configuration means for providing a first bowed configuration and a first flat configuration of the first wall 12.

Figure 12:
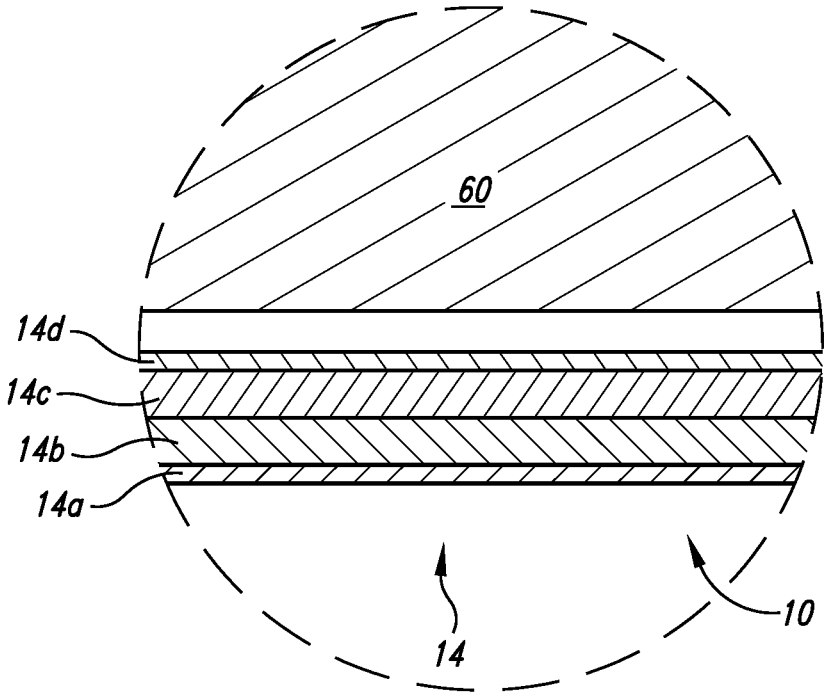
FIG. 12 is an enlarged cross-sectional side-elevational view showing a portion of second wall of the portable device case.

Turning now to FIG. 12 a portion of second wall 14 of portable device case 10 is shown in enlarged cross-sectional side-elevational view having exterior layer 14*a* (such as cortex material, dotted polyurethane or other poly material, other synthetic material, or other fabric material), inner layer 14*b* (such as semirigid board material such as a semirigid plastic material or other semirigid material that has flexibility sufficient to be in bowed configuration regarding expanded disposition and to be in flat configuration regarding collapsed disposition while having sufficient stiffness to maintain each configuration until sufficient force is applied to change configurations), inner layer 14*c* (such as foam material to protect device—foam material being placed internally to protect all six sides of portable device 60), and interior layer 14*d* (such as polyurethane or other poly material, other synthetic material, or other fabric material). Inner layer 12*b* and inner layer 14*b* can provide sufficient rigidity to keep first wall 12 and second wall 14 either bowed or flat regarding expanded disposition or collapsed disposition, respectively, of portable device case 10. In implementations, the inner layer 14*b*, as a semirigid board material, can serve as a second configuration means for providing a second bowed configuration and a second flat configuration of the second wall 14.

Figure 14:
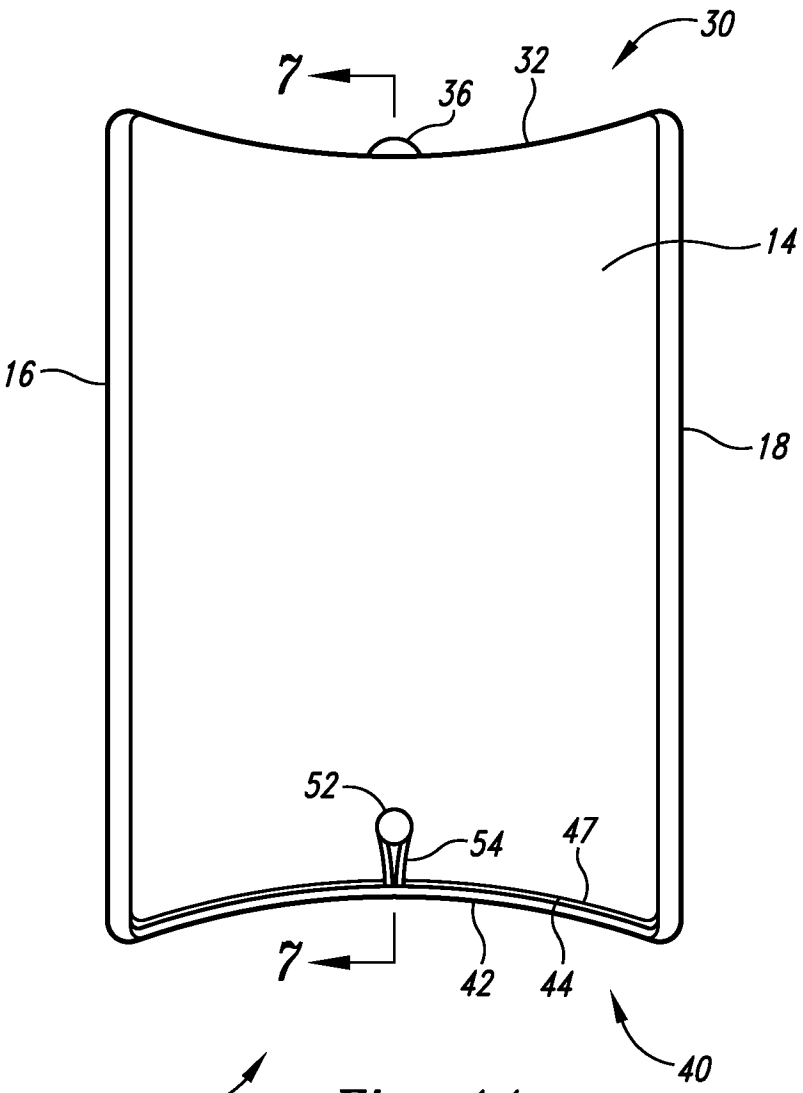
FIG. 14 is a top plan view of the second wall of the portable device case in expanded disposition.
Figure 13:
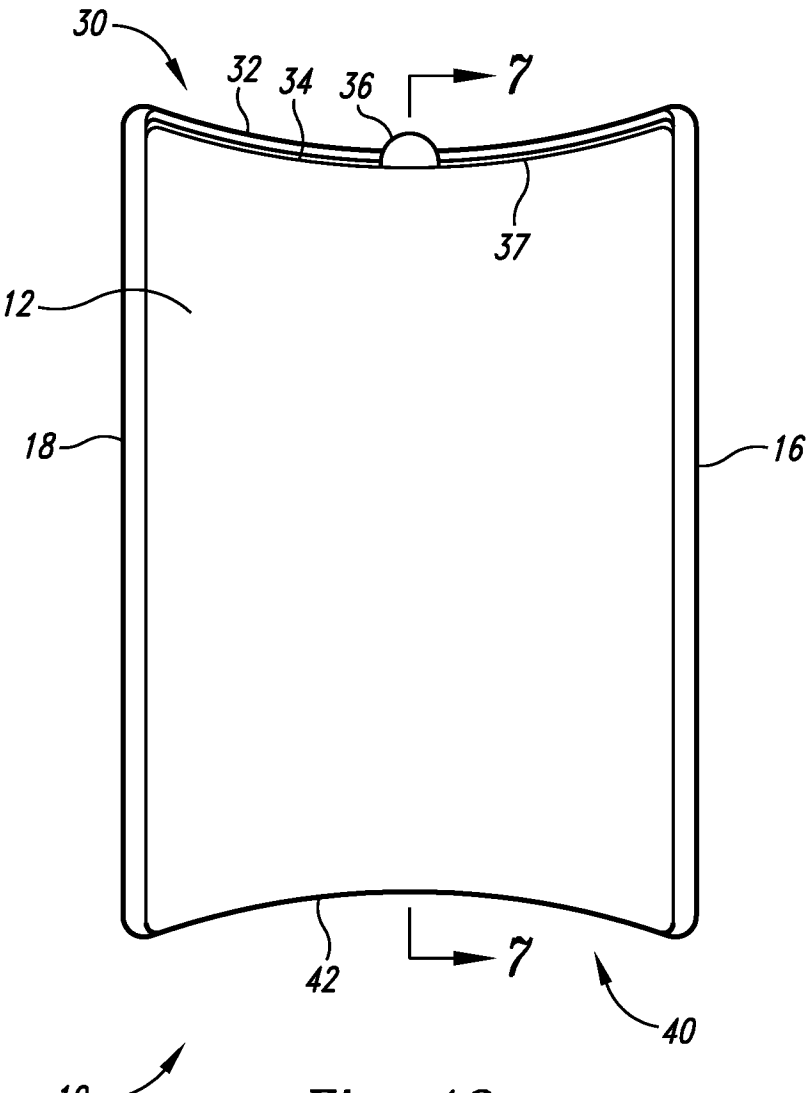
FIG. 13 is a top plan view of the first wall of the portable device case in expanded disposition.

Turning now to FIG. 13, shown is a top plan view of first wall 12 of portable device case 10 in expanded disposition with all flaps closed. Referring now to FIG. 14, shown is a top plan view of second wall 14 of portable device case 10 in expanded disposition with all flaps closed. As shown in FIGS. 13 and 14, given the bowed nature of walls 12 and 14 and curved nature of flaps 32, 34, 42, and 44, the corners of portable device case 10 extend farther than its center portion (along the 7-7 cut line shown), which can provide additional drop protection for portable device 60.

Figure 16:
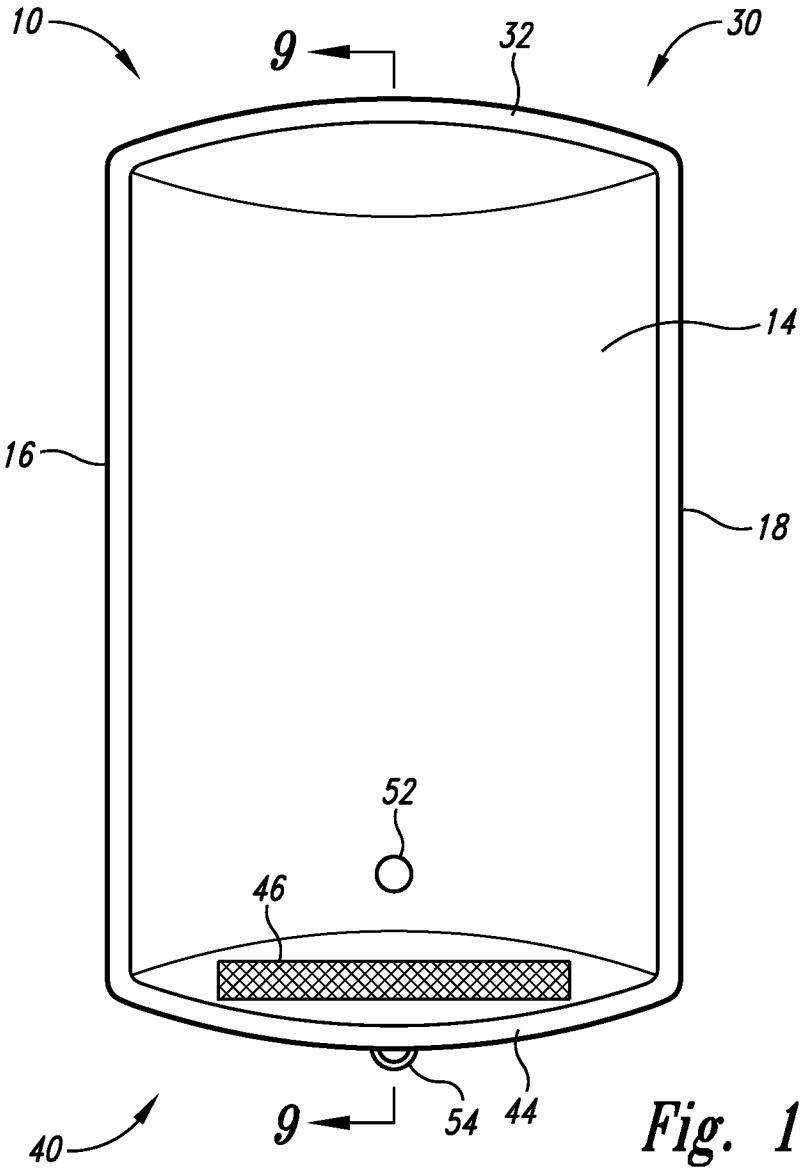
FIG. 16 is a top plan view of the second wall of the portable device case in expanded disposition.
Figure 15:
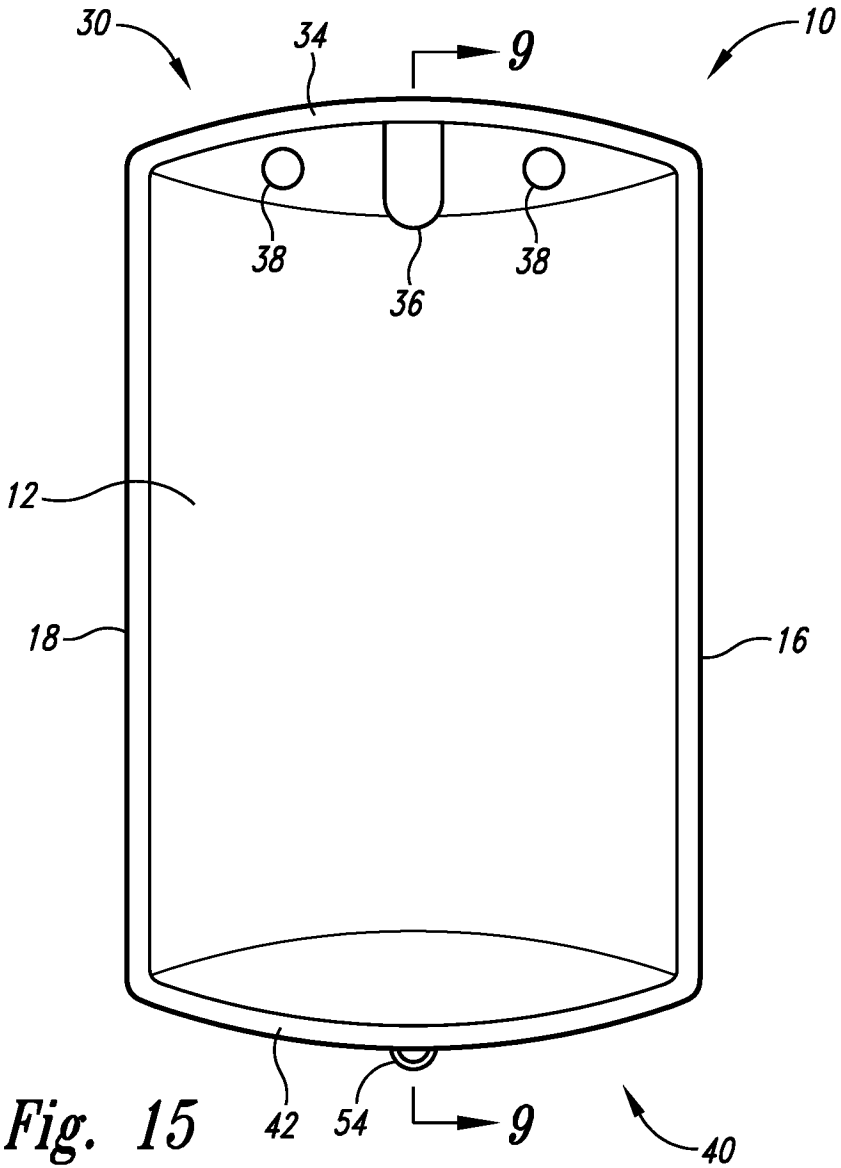
FIG. 15 is a top plan view of the first wall of the portable device case in expanded disposition.

Turning now to FIG. 15, shown is a top plan view of first wall 12 of portable device case 10 in expanded disposition with all flaps open. Referring now to FIG. 16, shown is a top plan view of second wall 14 of portable device case 10 in expanded disposition with all flaps open.

Figure 18:
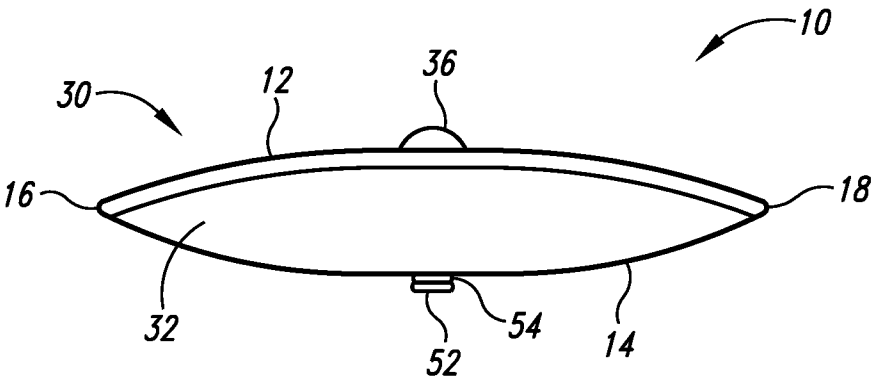
FIG. 18 is a side-elevational view of the first end of the portable device case in expanded disposition with the first flap of the first end and the second flap of the first end closed.
Figure 19:
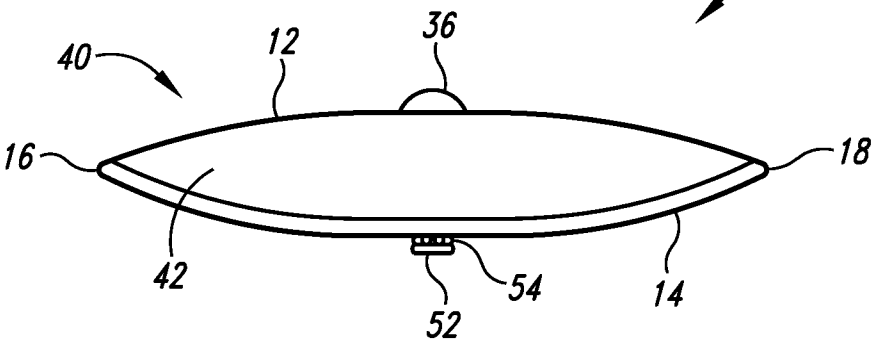
FIG. 19 is a side-elevational view of the second end of the portable device case in expanded disposition with the first flap of the second end and the second flap of the second end closed.
Figure 17:
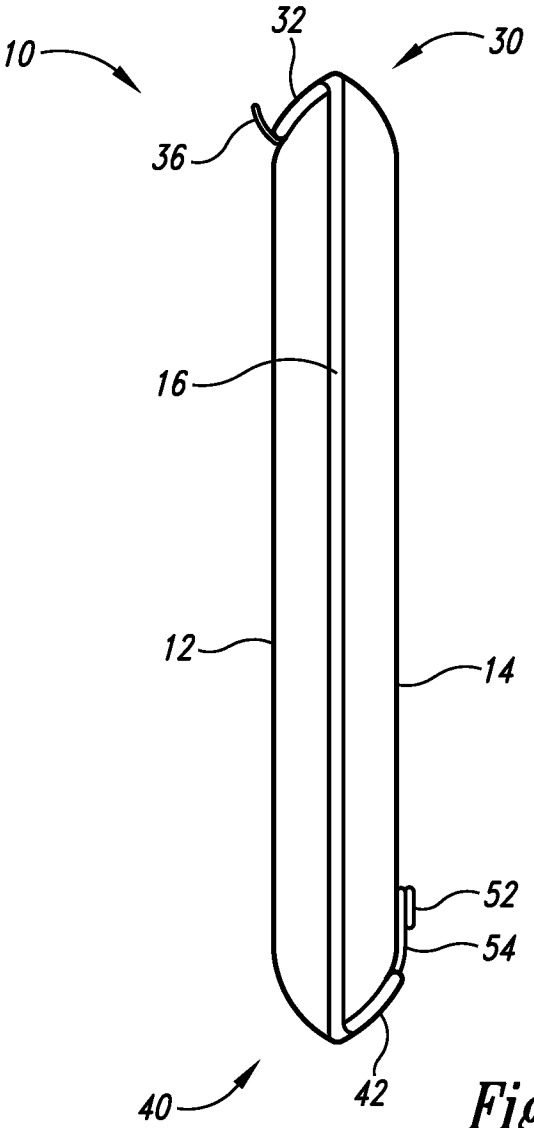
FIG. 17 is a side-elevational view of the portable device case in expanded disposition with first flap of first end closed, second flap of first end closed, first flap of second end closed, and second flap of second end closed.

Turning now to FIG. 17, shown is a side-elevational view of portable device case 10 in expanded disposition with all flaps closed. Referring now to FIG. 18, shown is a side-elevational view of first end 30 of portable device case 10 in expanded disposition with first flap 32 and second flap 34 closed. Turning now to FIG. 19, shown is a side-elevational view of second end 40 of portable device case 10 in expanded disposition with first flap 42 and second flap 44 closed.

Figure 21:
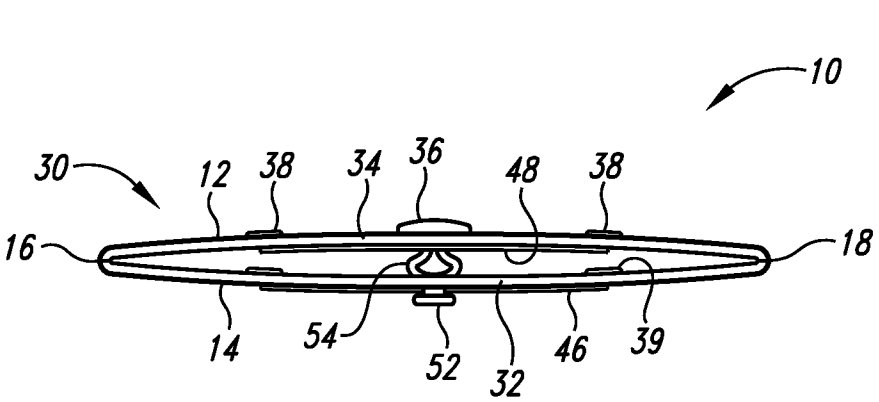
FIG. 21 is a side-elevational view of the first end of the portable device case in collapsed disposition with the first flap of the first end and the second flap of the first end open.
Figure 22:
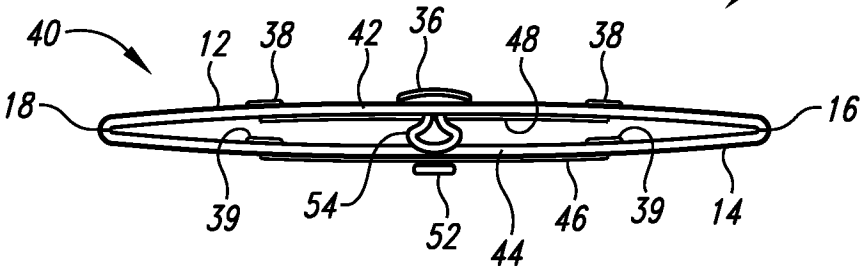
FIG. 22 is a side-elevational view of the second end of the portable device case in collapsed disposition with the first flap of the second end and the second flap of the second end open.
Figure 20:
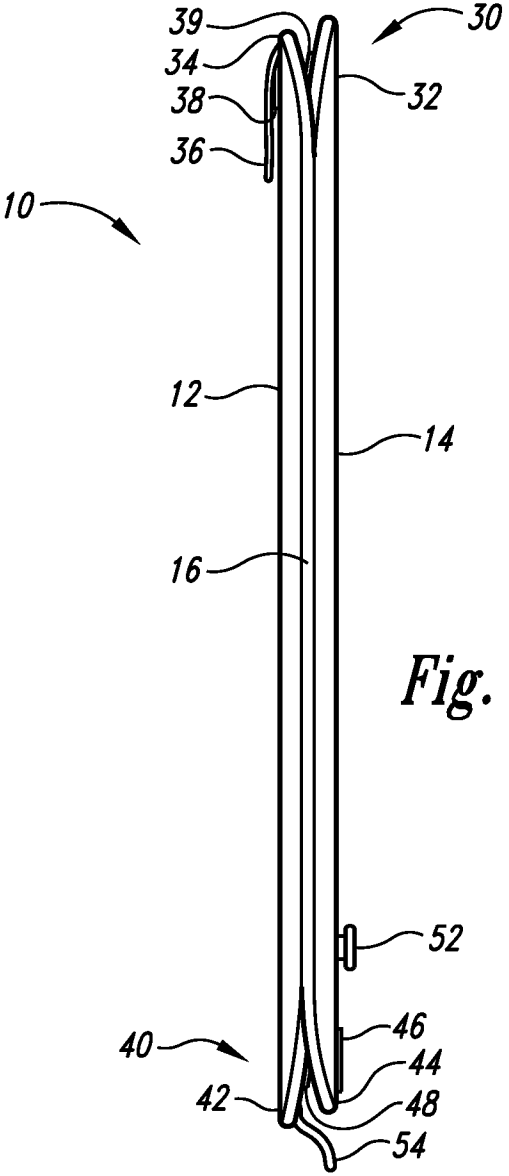
FIG. 20 is a side-elevational view of the portable device case in collapsed disposition with first flap of first end open, second flap of first end open, first flap of second end open, and second flap of second end open.

Referring now to FIG. 20, shown is a side-elevational view of the portable device case 10 in collapsed disposition with all flaps open. Turning now to FIG. 21 shown is a side-elevational view of first end 30 of portable device case 10 in collapsed disposition with first flap 32 and second flap 34 open. Referring now to FIG. 22, shown is a side-elevational view of second end 40 of portable device case 10 in collapsed disposition with first flap 42 and the second flap 44 open.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., " a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., " a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A portable electronic device case comprising:

a first side and a second side;

a first wall extending between the first side and the second side, the first wall including a first semirigid board with a first bowed configuration and a first flat configuration; and a second wall extending between the first side and the second side, the second wall including a second semirigid board with a second bowed configuration and a second flat configuration; wherein the portable electronic device case is capable of change of disposition between an expanded disposition and a collapsed disposition, the expanded disposition including the first semirigid board being in the first bowed configuration and the second semirigid board being in the second bowed configuration whereby the expanded disposition of the portable electronic device case includes an interior space sufficient to house a portable electronic device, the collapsed disposition with the first semirigid board being in the first flat configuration and the second semirigid board being in the second flat configuration, wherein the first wall includes one or more first layers of one or more first materials and the second wall includes one or more second layers of one or more second materials.

2. The portable electronic device case of claim 1 wherein the one or more first layers include a first exterior layer and wherein the one or more second layers include a second exterior layer.

3. The portable electronic device case of claim 2 wherein the one or more first layers include a first interior layer, the first semirigid board being positioned between the first exterior layer and the first interior layer, and wherein the one or more second layers include a second interior layer, the second semirigid board being positioned between the second exterior layer and the second interior layer.

4. The portable electronic device case of claim 3 wherein the first interior layer and the second interior layer comprise one or more polyurethane materials and the first exterior layer and the second exterior layer comprise one or more polyurethane materials.

5. The portable electronic device case of claim 3 wherein the one or more first layers includes a first inner layer positioned adjacent the first semirigid board, the first inner layer comprising one or more foam materials and wherein the one or more second layers includes a second inner layer positioned adjacent the second semirigid board, the second inner layer comprising one or more foam materials.

6. A portable electronic device case comprising:

a first side and a second side;

a first wall extending between the first side and the second side, the first wall including a first semirigid board with a first bowed configuration and a first flat configuration; and a second wall extending between the first side and the second side, the second wall including a second semirigid board with a second bowed configuration and a second flat configuration; wherein the portable electronic device case is capable of change of disposition between an expanded disposition and a collapsed disposition, the expanded disposition including the first semirigid board being in the first bowed configuration and the second semirigid board being in the second bowed configuration whereby the expanded disposition of the portable electronic device case includes an interior space sufficient to house a portable electronic device, the collapsed disposition with the first semirigid board being in the first flat configuration and the second semirigid board being in the second flat configuration;

a first end including a first flap and a second flap, the second flap extending from the first wall along a first edge, the first bowed configuration of the first wall including the first edge having an arch shape; and a tab, the tab affixed to the second flap.

7. A portable electronic device case comprising:

a first side and a second side;

a first wall extending between the first side and the second side, the first wall including a first semirigid board with a first bowed configuration and a first flat configuration; and a second wall extending between the first side and the second side, the second wall including a second semirigid board with a second bowed configuration and a second flat configuration; wherein the portable electronic device case is capable of change of disposition between an expanded disposition and a collapsed disposition, the expanded disposition including the first semirigid board being in the first bowed configuration and the second semirigid board being in the second bowed configuration whereby the expanded disposition of the portable electronic device case includes an interior space sufficient to house a portable electronic device, the collapsed disposition with the first semirigid board being in the first flat configuration and the second semirigid board being in the second flat configuration;

a first end including a first flap and a second flap, the second flap extending from the first wall along a first edge, the first bowed configuration of the first wall including the first edge having an arch shape; and a first magnet affixed to the first flap and a second magnet affixed to the second flap, the first magnet being in contact with the second magnet in the doubly closed position of the first end wherein the first flap includes a first open position and a first closed position, wherein the second flap includes a second open position and a second closed position, wherein the first end is doubly closed with the first flap being in the first closed position and the second flap being in the second closed position, wherein the first end is singly closed with the first flap being in the first open position and the second flap being in the second closed position, and wherein the first end is open for the first flap being in the first open position and the second flap being in the second open position.

8. A portable electronic device case comprising:

a first side and a second side;

a first wall extending between the first side and the second side, the first wall including a first semirigid board with a first bowed configuration and a first flat configuration; and a second wall extending between the first side and the second side, the second wall including a second semirigid board with a second bowed configuration and a second flat configuration; wherein the portable electronic device case is capable of change of disposition between an expanded disposition and a collapsed disposition, the expanded disposition including the first semirigid board being in the first bowed configuration and the second semirigid board being in the second bowed configuration whereby the expanded disposition of the portable electronic device case includes an interior space sufficient to house a portable electronic device, the collapsed disposition with the first semirigid board being in the first flat configuration and the second semirigid board being in the second flat configuration;

a second end including a first flap and a second flap, the second flap extending from the second wall along a second edge, the second bowed configuration of the second wall including the second edge having an arch shape; and an elastic band affixed to the first flap and a post affixed to the second wall, the elastic band sized to couple with the post in the doubly closed position of the second end wherein the first flap includes a first open position and a first closed position, wherein the second flap includes a second open position and a second closed position, wherein the second end is doubly closed with the first flap being in the first closed position and the second flap being in the second closed position, wherein the second end is singly closed with the first flap being in the first open position and the second flap being in the second closed position, and wherein the second end is open for the first flap being in the first open position and the second flap being in the second open position.

9. A portable electronic device case comprising:

a first side and a second side;

a first wall extending between the first side and the second side, the first wall including a first semirigid board with a first bowed configuration and a first flat configuration; and a second wall extending between the first side and the second side, the second wall including a second semirigid board with a second bowed configuration and a second flat configuration; wherein the portable electronic device case is capable of change of disposition between an expanded disposition and a collapsed disposition, the expanded disposition including the first semirigid board being in the first bowed configuration and the second semirigid board being in the second bowed configuration whereby the expanded disposition of the portable electronic device case includes an interior space sufficient to house a portable electronic device, the collapsed disposition with the first semirigid board being in the first flat configuration and the second semirigid board being in the second flat configuration wherein the first semirigid board and the second semirigid board are made from a semirigid plastic sheet material.

10. A portable electronic device case comprising:

a first side and a second side;

a first wall extending between the first side and the second side, the first wall having a bowed configuration and a flat configuration, the first wall including a first semirigid board of a sheet material and one or more layers of one or more first materials including a synthetic material exterior layer, a synthetic material interior layer, and a foam inner layer positioned therebetween, the first semirigid board positioned in juxtaposition to the foam inner layer;

a second wall extending between the first side and the second side, the second wall having a bowed configuration and a flat configuration, the second wall including a second semirigid board of sheet material and one or more layers of one or more second materials including a synthetic material exterior layer, a synthetic material interior layer, and a foam inner layer positioned therebetween, the second semirigid board positioned in juxtaposition to the foam inner layer;

a first end including a first flap and a second flap, the second flap extending from the first wall along a first edge, the bowed configuration of the first wall including the first edge having an arch shape, the first flap shaped to conform with the arch shape of the first edge, the first flap including a first open position and a first closed position, the second flap including a second open position and a second closed position, the first flap in the first closed position being in contact with the second flap in the second closed position; and a second end including a first flap and a second flap, the second flap extending from the second wall along a second edge, the bowed configuration of the second wall including the second edge having an arch shape, the first flap including a first open position and a first closed position, the second flap including a second open position and a second closed position, the first flap in the first closed position being in contact with the second flap in the second closed position.

11. A portable electronic device case of claim 10, further comprising a tab, a first magnet, a second magnet, a first hook-loop-fastener-strip-pair component, a second hook-loop-fastener-strip-pair component, an elastic band, and a post, the tab being affixed to the second flap of the first end, the first magnet being affixed to the first flap of the first end and the second magnet being affixed to the second flap of the first end, the first hook-loop-fastener-strip-pair component being affixed to first flap of the second end, the second hook-loop-fastener-strip-pair component being affixed to the second flap of the second end, the elastic band being affixed to the first flap of the second end, and the post being affixed to the second wall.

* * * * *